United States Patent [19]

Hirao et al.

[11] Patent Number: 4,731,265

[45] Date of Patent: Mar. 15, 1988

[54] METHOD OF MANUFACTURING MODIFIED WOOD MATERIAL

[75] Inventors: Shozo Hirao, Suita; Ayumu Yasuda, Hirakata; Yoshihiro Ohta, Takatsuki; Takashi Nakai, Shijonawate; Kazuo Seto, Toyonaka, all of Japan

[73] Assignee: Matsushita Electric Works, Ltd., Osaka, Japan

[21] Appl. No.: 896,964

[22] Filed: Aug. 15, 1986

[30] Foreign Application Priority Data

| | | | |
|---|---|---|---|
| Nov. 15, 1985 | [JP] | Japan | 60-257204 |
| Nov. 15, 1985 | [JP] | Japan | 60-257206 |
| Nov. 20, 1985 | [JP] | Japan | 60-261701 |
| Dec. 19, 1985 | [JP] | Japan | 60-285974 |

[51] Int. Cl.[4] ..... B05D 1/18

[52] U.S. Cl. ..... 427/440; 428/541; 428/907; 428/921

[58] Field of Search ..... 427/440; 428/541, 907, 428/921

[56] References Cited

U.S. PATENT DOCUMENTS 2,919,971 1/1960 Loetel .

4,591,515 5/1986 Dickinson et al. ..... 427/440 X

*Primary Examiner*—Michael R. Lusignan

*Attorney, Agent, or Firm*—Burns, Doane, Swecker & Mathis

[57] ABSTRACT

A method of manufacturing a modified wood material, wherein a raw wood material is processed in a first bath of a first solution containing metallic ions high in the affinity and showing insoluble and non-flammable properties within the wood material, and then in a second bath of a second solution containing negative ions which produces an insoluble, non-flammable inorganic composition upon reaction with the metallic ions, whereby the obtained modified wood material is made to have the insoluble, non-flammable inorganic composition produced and fixed therein to allow the material to hold a good flame retardancy and excellent rotproof and mothproof properties.

15 Claims, No Drawings

METHOD OF MANUFACTURING MODIFIED WOOD MATERIAL

TECHNICAL BACKGROUND OF THE INVENTION

This invention relates to methods of manufacturing modified wood materials and, more specifically, to a method of manufacturing a modified wood material by impregnating flammable natural woods with a non-flammable inorganic substance to render them highly durable.

The modified wood material having a high durability is useful because, when used as building materials, house interior finishing materials, furniture materials and the like, any fire occurring and spreading normally through the flammable woods can be remarkably suppressed and any attack by putrefactive bacteria, white ants or the like can be well avoided.

DISCLOSURE OF PRIOR ART

As a material simulative of wood grain surface to have woody appearance, there has been proposed a non-flammable board manufactured by mixing cement with wood fiber and setting the mixture. This board has been advantageous in its high non-flammability contributive to the suppression of fire spread, while disadvantageous in that the board has been lower in bending strength and workability than the woods and unsatisfactory in the wood grain simulation.

On the other hand, there has been suggested such a modified wood material that maintains a high bending strength, a fairly good workability and the woody appearance to keep the characteristics of woods effective. In this case, an attempt has been made to impregnate the woods with a non-flammable inorganic composition under predetermined conditions. However, this modified wood material has had a problem that, when the non-flammable inorganic composition is soluble in water, its use as the building material to be exposed to rain and snow causes the soluble composition to flow out of the modified material so as to render the material not to be effectively utilizable, and its use has had to be limited. When, on the other hand, the non-flammable inorganic composition is insoluble, there has been such a problem that the insoluble composition cannot be made to soak into the woods to the same extent as the soluble composition. This is considered to be due to the fact that the insoluble inorganic composition has usually a particle diameter of more than several *m whereas the wood texture has a pore diameter of about 0.1 *m at the narrowest part of the texture, that is, at a so-called pit membrane, and thus particles of the insoluble composition cannot be soak into the wood texture.

Disclosed in U.S. Pat. No. 2,919,971 to Charles E. Loetel is an example of the modified wood material, which is designed not to have a fire retardant property but a rotproof property, and thus teaches a method of manufacturing a modified wood material comprising the steps of immersing a raw woods in a first solution of high concentration metallic salt sulfate such as $CuSO_4$ or $ZnSO_4$, stoichiometrically processing of soluble chromate as a second solution, immersing the woods impregnated with the first solution into the second solution to have the first solution reacted with the second solution to have particles of the insoluble chromate sedimented from the second solution in the woods, and contacting a third zinc sulfate solution with the second solution excessively remaining in or on the woods until the third solution reacts with the remaining second solution. According to this Patent to Loetel, a cooling tower is made with use of the thus obtained modified wood materials, in which there may be provided a water resistance to some extent and eventually the rotproof property by means of the insoluble chromate particles sedimented in many fine pores in the surface of the woods to coat the woods with the insoluble chromate.

It is already known that, in order to provide the flame retardant property to the woods, a considerable amount of chromate must be impregnated in the woods. However, there still remains a problem that no sufficient flame retardant property can be provided to the modified wood material, since the chromate particle is also larger in diameter than the gap diameter at the narrowest part of the wood texture and thus cannot sufficiently soak into the wood texture, though the Loetel Patent is achieving its object of providing only the rotproof property to the woods. The Loetel Patent still leaves problems unsolved in that, since the first to third solutions must be prepared, the first of which being reacted with the second one which further requiring a reaction with the third one, many steps of impregnation of the inorganic composition in the woods are required, and that, since the originally insoluble chromate must be stoichiometrically processed to prepare the soluble second solution, the steps are caused to be further complicated.

TECHNICAL FIELD OF THE INVENTION

A primary object of the present invention is, therefore, to provide a method of manufacturing a modified wood material wherein a relatively high proportion of insoluble inorganic composition is impregnated in a raw wood material through relatively simplified manufacturing steps to provide a sufficient flame retardant property to the wood, and further to provide a high water resistance to the wood, i.e., remarkably reduce its moisture absorption and improve its rotproof and mothproof properties, while effectively suppressing any flowing of the inorganic composition out of the wood with the insolubility of the composition utilized so as to improve its dimensional stability, and thus any change with time lapsed to a large extent.

According to the present invention, the above object is attained by providing a method for manufacturing a modified wood material impregnated with an insoluble, non-flammable composition by immersing a raw wood material into two sorts of water-soluble inorganic compound solutions which produce the insoluble, non-flammable composition upon reaction with each other, wherein the method comprises the steps of processing the raw wood material in a first bath of a first solution containing metallic ions high in the affinity and showing insoluble and non-flammable properties within the wood material, and processing the raw wood material in a second bath of a second solution containing negative ions for causing the insoluble, non-flammable inorganic composition produced upon reaction with the metallic ions.

In the present invention arranged as above, an inorganic salt exhibiting insolubility and non-flammability is made to impregnate at a considerably high efficiency into the raw wood material even through the narrowest parts of the wood texture and to be dispersed and fixed therein in the form of the insoluble inorganic composition, so that a high proportion of, desirably, more than 40 weight % (in absolute dry weight) of such inorganic composition can be made to impregnate in the wood material, whereby the modified wood material can be obtained with a high insolubility, non-flammability, rotproof and mothproof properties and dimensional stability.

Other objects and advantages of the present invention shall be made clear in the following invention shall be made clear in the following description of the invention detailed with reference to respective examples described later.

The term "flame retardant" used herein means that impregnation of the high proportion of non-flammable inorganic composition in a flammable material enables the flaming of the material to be remarkably suppressed though causing a pyrolysis, that is, the flammable material can have a so-called self-extinguishing property.

The term "modified" refers to a provision to an originally flammable wood material a flame retardant property to such an extent that the modified wood can be officially approved at least as a quasi-non-flammable material in accordance with, for example, JIS (Japanese Industrial Standard), and further desirably to providing a dimensional stability and rotproof and mothproof properties.

The term "wood material" refers to a wide range of wood materials which include raw wood logs, sawn wood articles, sliced veneers, plywoods and so on which are effectively used as building materials, house interior finishing materials, furniture materials, and the like.

While the present invention shall now be described with reference to the preferred examples disclosed, it should be understood that the intention is not to limit the invention only to the particular examples disclosed but rather to cover all alterations, modifications and equivalent arrangements possible within the scope of appended claims.

DISCLOSURE OF PREFERRED EMBODIMENTS

According to a first feature of the present invention, first and second baths respectively of one of two sorts of water-soluble inorganic compound aqueous solutions are prepared for separating out an inorganic composition having desired insolubility and non-flammability by mixing the two solutions with each other. First, a piece of a raw wood material is immersed in the first bath and then in the second bath until the wood material is sufficiently impregnated with the solutions, to have the solutions sufficiently soaked throughout the wood texture and the insoluble and non-flammable inorganic composition fixed within the wood texture, and a modified wood is obtained.

More specifically, according to an optimum embodiment for realizing the above feature, a raw wood material is first saturated with water and is then immersed in the first bath, which bath is of the first water-soluble inorganic compound aqueous solution containing metallic ions which are high in the affinity and show insolubility and non-flammability as present in the wood material. The first aqueous solution is made to sufficiently impregnate in the wood material until the solution reaches the inside pores of the wood texture. Then, the wood material impregnated with the first aqueous solution is immersed in the second bath, which is of the second water-soluble inorganic compound aqueous solution containing negative ions which react with the metallic ions of the first bath to separate the insoluble, non-flammable inorganic composition out of the first solution. Immersion time and temperature of the second bath are set usually to be 3 hours to several days and 40° to 80° C., respectively, but these conditions may be properly changed according to the thickness or size of the raw wood material and the quantity of the insoluble, non-flammable inorganic composition to be deposited and fixed in the wood texture.

In this case, the first and second aqueous solutions may not be limited respectively to be of only one compound but a mixture of a plurality of compounds. In addition, the water-soluble inorganic compound aqueous solution at least for one of the two baths is set to be 5.0 or higher in the solubility in water.

The insoluble, non-flammable inorganic compounds to be deposited and fixed in the raw wood material during the immersion in the second bath may be calcium carbonate, calcium phosphate, calcium hydroxide, calcium sulfate, calcium silicate, magnesium carbonate, magnesium phosphate, magnesium hydroxide, magnesium ammonium phosphate, magnesium silicate, aluminum hydroxide, aluminum phosphate, aluminum silicate, barium carbonate, barium sulfate, barium phosphate, zinc phosphate or the like. Referring to these insoluble, non-flammable inorganic compounds, the first and second inorganic compounds to react with each other for the separation may be those which are in Table I as follows, in which one or a mixture of two or more of compounds included in each of the first and second inorganic compound groups listed for each of such compounds to be separated as named on left end side of the Table can be used as the compound for each of the two solutions:

TABLE I

| | | |
|---|---|---|
| Calcium carbonate | 1st inorg. compd. | Calcium bromide, calcium chloride, calcium chlorate, calcium nitrate, calcium nitrite, calcium chromate, calcium acetate, etc. |
| | 2nd inorg. compd. | Ammonium carbonate, potassium carbonate, potassium hydrogen carbonate, sodium carbonate, sodium hydrogen carbonate, sodium potassium carbonate, etc. |
| Calcium phosphate | 1st inorg. compd. | (Same as the first inorganic compound compound group as above for calcium carbonate) |
| | 2nd inorg. compd. | Phosphoric acid, sodium phosphate, potassium phosphate, ammonium phosphate, etc. |
| Calcium hydroxide | 1st inorg. compd. | (Same as the first inorganic compound group for calcium carbonate) |
| | 2nd inorg. compd. | Sodium hydroxide, potassium hydroxide, ammonium, etc. |
| Calcium sulfate | 1st inorg. compd. | (Same as the first inorganic compound compound group for calcium carbonate) |
| | 2nd inorg. compd. | Aluminum sulfate, sodium sulfate, sodium hydrogen sulfate, potassium sulfate, potassium hydrogen sulfate, magnesium sulfate, ammonium sulfate, sodium aluminum sulfate, potassium aluminum sulfate, ammonium aluminum sulfate, potassium magnesium sulfate, etc. |
| Calcium silicate | 1st inorg. compd. | (Same as the first inorganic compound compound group in calcium carbonate) |
| | 2nd inorg. | Sodium silicate, potassium silicate, etc. |

TABLE I-continued

| | | |
|---|---|---|
| | compd. | |
| Magnesium carbonate | 1st inorg. compd. | Magnesium chloride, magnesium sulfate, etc. |
| | 2nd inorg. compd. | (Same as the second inorganic compound group for calcium carbonate) |
| Magnesium phosphate | 1st inorg. compd. | (Same as the first inorganic compound group for magnesium carbonate) |
| | 2nd inorg. compd. | (Same as the second inorganic compound group for calcium phosphate) |
| Magnesium hydroxide | 1st inorg. compd. | (Same as the first inorganic compound magnesium carbonate) |
| | 2nd inorg. compd. | (Same as the second inorganic compound group for calcium hydroxide) |
| Magnesium ammonium phosphate | 1st inorg. compd. | (Same as the first inorganic compound group for calcium phosphate) |
| | 2nd inorg. compd. | Magnesium mixture solution such as a mixture solution of magnesium chloride, ammonium chloride and ammonium, etc. |
| Magnesium silicate | 1st inorg. compd. | (Same as the first inorganic compound group for magnesium carbonate) |
| | 2nd inorg. compd. | (Same as the second inorganic compound group for calcium silicate) |
| Aluminum hydroxide | 1st inorg. compd. | Aluminum chloride, aluminum bromide, aluminum bromide, aluminum iodide, aluminum nitrate, aluminum sulfate, etc. |
| | 2nd inorg. compd. | (Same as the second inorganic compound group for calcium hydroxide) |
| Aluminum phosphate | 1st inorg. compd. | (Same as the first inorganic compound compound group for aluminum hydroxide) |
| | 2nd inorg. compd. | (Same as the second inorganic compound group for calcium phosphate) |
| Aluminum silicate | 1st inorg. compd. | (Same as the first inorganic compound group for aluminum hydroxide) |
| | 2nd inorg. compd. | (Same as the second inorganic compound compound group for calcium silicate) |
| Barium carbonate | 1st inorg. compd. | Barium chloride, barium bromide, barium iodide, barium nitrate, barium hydroxide, etc. |
| | 2nd inorg. compd. | (Same as the second inorganic compound group for calcium carbonate) |
| Barium sulfate | 1st inorg. compd. | (Same as the first inorganic compound group for barium carbonate) |
| | 2nd inorg. compd. | (Same as the second inorganic compound group for calcium sulfate) |
| Barium phosphate | 1st inorg. compd. | (Same as the first inorganic compound group for barium carbonate) |
| | 2nd inorg. compd. | (Same as the second inorganic compound group for calcium phosphate) |
| Zinc phosphate | 1st inorg. compd. | Zinc chloride, zinc bromide, zinc iodide, zinc nitrate |
| | 2nd inorg. compd. | (Same as the second inorganic compound group for calcium phosphate) |

Practical examples according to the present feature of the invention shall be explained in the following:

EXAMPLE 1

A saturated sodium carbonate aqueous solution was put in a first bath, a single ply of Japanese cedar plate of 1 mm thick was immersed in the first bath, and the bath was subjected to vacuum to impregnate the plate with sodium carbonate. Then, the plate impregnated with sodium carbonate was immersed in a second bath of a saturated calcium chloride heated at a temperature of 50° C. and was left as immersed for 5 hours. Subsequently, the plate was taken out of the second bath and dried to obtain a modified single ply wood plate.

EXAMPLE 2

The same sort of plate as above was processed in the same manner as in EXAMPLE 1, except that a saturated sodium potassium carbonate aqueous solution instead of the saturated sodium carbonate aqueous solution was used for the first bath and the plate was left for 7 hours as immersed in the second bath, and a modified single ply wood plate was obtained.

EXAMPLE 3

The plate as above was processed in the same manner as in EXAMPLE 1, except that a saturated potassium carbonate aqueous solution in place of the saturated sodium carbonate aqueous solution was used for the first bath and the plate was left for 9 hours as immersed in the second bath, and a modified single ply wood plate was obtained.

EXAMPLE 4

The plate as above was processed in the same manner as in EXAMPLE 1, except that a saturated ammonium carbonate aqueous solution in place of the saturated sodium carbonate aqueous solution was used for the first bath, a saturated calcium bromide aqueous solution in place of the saturated calcium chloride aqueous solution was used for the second bath, the plate was left for 11 hours as immersed in the second bath, and a modified single ply wood plate was obtained.

EXAMPLE 5

A single ply Japanese cypress plate of 1 mm thick instead of Japanese cedar was processed in the same manner as in EXAMPLE 1, except that a saturated magnesium chloride in place of the saturated calcium chloride aqueous solution was used for the second bath, and a modified single ply wood plate was obtained.

The modified wood plates thus obtained in these EXAMPLES 1 to 5 were subjected to measurement of increments in their weight and to flame-retardation tests in accordance with JIS Standard A1321, results of which were as in Table II below.

TABLE II

| EXAMPLE | Weight of the plate with that of the raw material assumed as being 100 | Flame retardation |
|---|---|---|
| 1 | 190 | Good |
| 2 | 220 | Good |
| 3 | 240 | Good |
| 4 | 260 | Good |
| 5 | 170 | Good |

It will be seen from Table II that any one of the modified single ply wood plates obtained through EXAMPLES 1 to 5 contains more than 40 weight % of the insoluble, non-flammable inorganic composition, exhibiting a good flame retardant property. The insoluble, non-flammable inorganic composition, after having been fixed in the plate, exhibits a solubility of 1.0 or less and does not dissolve even when such fixed composition is immersed again in water for many hours, and the modified wood plates can be usefully employed as exterior covering building materials. It has also been found that, since such fixed inorganic composition will not be soluble in water, it will not be subjected to any change in quality with time elapsed while providing a good dimensional stability. Further, it has been found that the conventional non-flammable board prepared by mixing the wood fiber material with cement has a bending strength of about 100 $Kg/cm^2$, whereas the modified single ply wood plates according to the above examples have a bending strength of about 1,000 $kg/cm^2$, about 10 times of that of the conventional board.

According to a second feature of the present invention, a calcium halide aqueous solution and a hydrogen phosphate series aqueous solution, the latter containing at least one selected from the group consisting of metallic salt dihydrogen phosphate, dimetallic salt hydrogen phosphate and trimetallic salt phosphate, are impregnated in a raw wood material, the interior of the thus impregnated material is made to keep alkaline state, thereafter the material is cured to form hydroxy-apatite therein, and a modified wood is obtained.

More in detail, in an embodiment realizing the second feature, the hydrogen phosphate series aqueous solution containing at least one selected from the group consisting of metallic salt dihydrogen phosphate, dimetallic salt hydrogen phosphate and trimetallic salt phosphate is put in the first bath as the first inorganic compound aqueous solution, and the raw wood material is immersed in the first bath. Then the material sufficiently impregnated with the first aqueous solution is immersed in the second bath containing, as the second inorganic compound aqueous solution, the calcium halide aqueous solution so that the second solution reacts with the first solution while keeping the alkaline state of the interior of the material to have hydroxy-apatite produced inside the wood material.

In this case, it is preferable to use, as the first inorganic compound, metallic salt dihydrogen phosphate, dimetallic salt hydrogen phosphate or trimetallic salt phosphate, but such metallic salt as potassium can be also used. As the second inorganic compound, calcium chloride, calcium bromide, calcium iodide or the like is used. It has been found that, when the first and second aqueous solutions are directly mixed to produce hydroxy-apatite, it is desirable to set their molar ratio to be 3:5. Accordingly, it is preferable to also set the molarity ratio between the first and second aqueous solutions to be 3:5. Since the production of hydroxy-apatite is advanced with the retention of the alkaline state in the reactive system, sodium hydroxide or the like is added so that phosphoric acid series aqueous solution has a pH level exceeding 7 to keep the alkaline state inside the wood material, while the pH level is to be properly adjusted depending on the type of wood, reaction conditions, and the like.

While the impregnation of the first aqueous solution is to be carried out by means of the immersion or the like and the raw wood material in its air dried or absolute dry condition requires a considerable long time for the impregnation, it may be possible to shorten the impregnating time when the wood material is previously immersed in water to be saturated therewith. In having hydroxy-apatite fixed within the raw wood material by impregnating it with the phosphoric acid series aqueous solution and curing the impregnated material, it is preferable to carry out the curing while heating the impregnated material at, for example, 60° C. for about 3 hours, which heating conditions can be varied properly according to the type of the raw wood material and so on.

Practical examples of manners for realizing the second feature shall be explained below.

EXAMPLE 6

A single-ply wood plate of Japanese cedar of 1 mm thick was immersed in water as a pretreatment, adjusted to be 200 weight % in water content, and then immersed in a first bath of a disodium hydrogen phosphate aqueous solution having a molarity of 0.9 and a pH level of 9.42. After the wood plate was immersed in the first bath for 6 hours, the plate was moved into a second bath of a calcium chloride aqueous solution having a molarity of 1.5 and kept at a temperature of 70° C., with the plate immersed therein, for 12 hours. Thereafter, the plate was removed out of the second bath, heated to 60° C., cured for 3 hours at the same temperature to be dried, and a modified single ply wood plate was obtained.

EXAMPLE 7

A single-ply wood plate of air-dried Japanese cedar of 3 mm thick was immersed in the first bath of disodium hydrogen phosphate aqueous solution having the molarity of 0.9 and pH level of 9.42, heated to 70° C. and left as immersed for 12 hours. Then the plate thus impregnated with the first aqueous solution was immersed in the second bath of calcium chloride aqueous solution having the molarity of 1.5, heated to 70° C. and left as immersed for 18 hours. After that, the plate was taken out of the second bath, heated to 60° C., cured for 3 hours at the same temperature to be dried, and a modified single-ply wood plate was obtained.

EXAMPLE 8

A single-play wood plate of Japanese cedar of 1 mm thick was immersed in water as a pretreatment, adjusted to be 200 weight % in water content, and then immersed in a first bath of calcium chloride aqueous solution having a molarity of 1.5. The bath temperature was raised to 70° C., and the plate was left as immersed for 6 hours at the same temperature. Subsequently, the plate was immersed in a second bath of disodium hydrogen phosphate having a molarity of 0.9 and a pH level of 0.9, heated to 70° C. and left as immersed for 12 hours. After that, the plate was removed out of the second bath, heated to 70° C., cured for 12 hours at the same temperature and dried, and a modified single-ply wood plate was obtained.

The respective modified wood plates thus obtained in these EXAMPLES 6 to 8 were subjected to measurement of increments in their weight, to flame-retardation tests in accordance with JIS Standard A1321, and to measurement of their anti-shrinkage efficiency (ASE), results of which were as in Table III below.

TABLE III

| EXAMPLE | Weight increase (%) | Flame-retardation | ASE (%) |
|---|---|---|---|
| 6 | 68 | Good | 42 |
| 7 | 42 | Good | 36 |

TABLE III-continued

| EXAMPLE | Weight increase (%) | Flame-retardation | ASE (%) |
|---|---|---|---|
| 8 | 37 | Good | 28 |

It will be seen from the above Table III that the modified wood plate obtained in any of EXAMPLES 6 to 8 contains the insoluble, non-flammable inorganic compound at a high percentage while exhibiting a good flame retardation. It has been also found that the plates have a good ASET value and a high dimensional stability.

According to a third feature of the present invention, apatite can be formed in the wood material to obtain a modified wood material on a different standpoint. More specifically, the apatite belongs to a hexagonal system space group $P6_3/m$ and has a fundamental composition $M_{10}(ZO_4)_6X_2$ such as the foregoing hydroxy-apatite $Ca_{10}(PO_4)_6(OH)_2$, where various constitutional ion species of monovalence to trivalence, trivalence to heptavalence, and zero-valence to trivalence may be put in M, Z and X sites, respectively, and ones including $H_2O$ can be put in the X site, so that ones including water of crystallization also can be produced.

In realizing the third feature, the raw wood material is immersed in the first bath of a first aqueous solution capable of containing ions to be placed in the M site and ions or molecules to be placed in the X site, and then the wood material impregnated with he first aqueous solution is immersed in the second bath of a second aqueous solution capable of containing ions constituting ZO and ions or molecules to be placed in the X site. In this case, as in the second feature, the production of apatite is accelerated so long as the reaction system is kept alkaline. Therefore, the first and second solutions are reacted with each other while the reaction system is kept alkaline, and there can be obtained a modified wood material having apatite as the insoluble, non-flammable inorganic compound fixed within the raw wood material.

For the respective M, Z and X sites of the fundamental apatite composition, one or a combination of two or more selected from each of groups listed in Table IV below may be employed.

TABLE IV

| | |
|---|---|
| M | Calcium, zinc, cadmium, strontium, nickel, europium, aluminum, yttrium, lanthanum, cerium sodium, potassium, barium, etc. |
| Z | Phosphorus, arsenic, vanadium, chromium, silicon, carbon, aluminum, sulfur, rhenium, boron, etc. |
| X | Hydroxide, fluorine, chlorine, bromine, iodine, oxygen, nitrogen, carbon trioxide, hydrogen oxide |

In this case, the X site may take a vacancy □. In the respective M, Z and X sites, one or more of the substances selected from the respective groups should be properly combined to form apatite in the wood material taking into consideration the ion diameter and the like of the selected substances. When it is desirable to have the flame retardation provided by apatite, it is preferable to use phosphorus, boron or sulfur for the Z site, and such halogen as chlorine for the X site. As important apatites, there can be enumerated $Ca_{10}(PO_4)_5(OH)_2$, $Ca_{10}(PO_4)Cl_2$, $Ca_{10}(PO_4)F_2$, $Ca_{10}(PO_4)FxCl_{2-x}$, $Ba_{10}(PO_4)_5(BO_4)\beta_2$, $Ca_9Ni(PO_4)_6F_2$, $Ca_8Al_2(PO_4)_5(AlO_4)F_2$, and the like.

In producing these important apatites, the raw wood material is immersed in the first bath of a first processing solution containing at least one of such ions capable of being M as $Ca^{2+}$, $Ba^{2+}$, $Al^{3+}$, $Ni^{2+}$ and the like to have the material impregnated with the first processing solution, and then immersed in the second bath of a second processing solution containing at least one of such ions capable of forming $ZO_4$ as $PO_43-$, $BO_33-$, $AlO_2-$ and the like and at least one of such ions or molecules capable of being X as $Cl^-$, $F^-$ and the like and adjusted to be alkaline, to have the material impregnated with the second processing solution. Thereafter, the wood material is preferably heated, cured and dried. As a result, apatite is made to be fixed within the wood material in the form of an insoluble, non-flammable inorganic compound. When the second processing solution is not adjusted to be alkaline, such a third alkaline processing solution as, for example, sodium hydroxide, ammonium and the like may be added. The optimum pH level during the reaction is in a range of 8.5 and 12.

When it is desired to produce such apatite having a vacancy □ at the X site, it is unnecessary to use any ions or molecules which can be in the X site. When it is desired to form apatite having a hydroxyl group at the X site, the processing solution contains OH— and no ions which can be X may be employed. In the case of such apatite as containing hydrogen oxide, it should be appreciated that an endothermic reaction caused to occur under such conditions that water of crystallization in the apatite is emitted will render the flame retardant property to be further improved.

Practical examples for realizing the third feature will be explained below.

EXAMPLE 9

Single-ply wood plates respectively of pine, Japanese cedar and beech wood of 2 mm thick were immersed in water at a normal temperature under a reduced pressure of about 1 Torr for 5 hours to have them sufficiently saturated with water, as a pretreatment. Then the respective wood plates were immersed in the first bath of a first aqueous solution of $Ca_2Cl.8H_2O$ heated to 70° C., and were left as immersed therein for 5 hours. Next, the respective plates impregnated with the first aqueous solution were immersed in the second bath of a second aqueous solution containing 40 weight % of trisodium phosphate and heated to 70° C. while adjusted to be 9 in the pH level by adding sodium hydroxide, and left as immersed for 8 hours. Thereafter, the plates were taken out of the second bath, washed with water and dried, and modified wood plates containing hydroxy-apatite $Ca_{10}(PO_4)_6(OH)_2$ were obtained.

EXAMPLE 10

Respective wood plates pretreated in the same manner as in EXAMPLE 9 were immersed in the first bath of a first aqueous solution of $CaCl_2.8H_2O$ heated to 70° C., and were left as immersed for 5 hours. Next, the respective plates impregnated with the first aqueous solution were moved into the second bath of a second saturated aqueous solution of a mixture of trisodium phosphate and calcium chloride and heated to 70° C. while adjusted to be 9 in the pH level by adding sodium hydroxide, and were left as immersed for 8 hours. Thereafter, the plates were taken out of the second bath, washed with water and dried, and modified wood plates containing a mixture of inorganic compounds of hydroxy-apatite $Ca_{10}(PO_4)_6(OH)_2$ and chloro-apatite $Ca_{10}(PO_4)_6Cl_2$.

EXAMPLE 11

Respective wood plates pretreated in the same manner as in EXAMPLE 9 were immersed in the first bath of a first barium chloride aqueous solution heated to 70° C., and were left as immersed for 5 hours. The plates impregnated with the first aqueous solution were moved into the second bath of a second saturated aqueous solution of trisodium phosphate and boric acid, heated to 70° C. while adjusted to be 9 in the pH level by adding sodium hydroxide, and were left as immersed for 8 hours. Thereafter, the respective plates were taken out of the second bath, washed with water and dried, and modified wood plates containing $Ba_{10}(PO_4)_5(BO_4)\square_2$ were obtained.

The respective modified wood plates thus obtained in these EXAMPLES 9 to 11 were subjected to measurement of increments in their weight and to flame-retardation tests according to JIS Standard A1321, results of which were as shown in Table V below.

TABLE V

| EXAMPLE | Weight increment (%) | Flame retardation |
|---|---|---|
| 9 | 18 | Good |
| 10 | 24 | Good |
| 11 | 17 | Good |

It will be seen from Table V that all the modified wood plates obtained in EXAMPLES 9 to 11 according to the third feature contain an inorganic compound high in the insolubility and non-flammability, thus realizing the good flame retardant property and dimensional stability.

According to a fourth feature of the present invention, only the production of phosphoric acid series metallic salt partly shown with reference to the first feature is perceived, and the phosphoric acid series metallic salt is dispersed and fixed in the wood material. For the phosphoric acid series metallic salts, there may be enumerated such substances as aluminum phosphate, dialuminum hydrogen phosphate, aluminum dihydrogen phosphate, calcium phosphate, calcium hydrogen phosphate, calcium dihydrogen phosphate, magnesium phosphate, magnesium hydrogen phosphate, magnesium dihydrogen phosphate and the like.

More specifically, in embodiments realizing the fourth feature, the raw wood material is immersed in the first bath of a first aqueous solution containing such metallic ion as $Al^{3+}$, $Ca^{2+}$ or $Mg^{2+}$, and then the material impregnated with the first aqueous solution is immersed in the second bath of a second aqueous solution containing phosphoric acid ions, which second aqueous solution is adjusted to be substantially neutral and preferably between 7 and 8 in the pH level during the reaction between metallic ions and phosphoric acid ions, whereby metallic salt phosphate is deposited and fixed in the wood.

For the first aqueous solution containing metallic ions, in this case, an aqueous solution of one or more of aluminum chloride, aluminum sulfate, calcium chloride, magnesium chloride, magnesium phosphate and the like may be used and, for the second aqueous solution, an aqueous solution of one of disodium hydrogen phosphate phosphoric acid and the like or a combination thereof may be employed. When two or more compounds are combined and mixed, care must be paid so as not to form any insoluble salts during the mixture. Further, when the aqueous solution tends to be acidic during the pH adjustment, such an aqueous solution as a sodium hydroxide or ammonium solution can be added to keep the pH level at about 7 or 8.

In the case where the raw wood material is a single-ply plate member or the like, the present fourth feature can be realized even by means of a method of application of the first and second aqueous solution, instead of the immersion.

Practical examples for realizing the fourth feature will be explained below:

EXAMPLE 12

A 2 mm thick single-ply plate of beech wood was immersed in water at 85° C. for 5 hours to be sufficiently saturated with water, as a pretreatment. Then the plate was immersed in the first bath of a first aqueous solution of 50 weight % aluminum for 5 hours sulfate and heated to 85° C. Next, the plate impregnated with the first aqueous solution was immersed in the second bath of a second aqueous solution of 50 weight % disodium hydrogen phosphate and heated to 85° C., and then left as immersed for 5 hours. In the second bath, because the pH level shifted to an acidic level during immersion of the plate, sodium hydroxide was added to keep the pH level substantially at 8. Thereafter, the plate was taken out of the second bath, washed with hot water to remove unreacted matters or by-products from the plate and dried, and a modified wood plate having dialuminum hydrogen phosphate fixed therein was obtained.

EXAMPLE 13

As a pretreatment, the 2 mm thick single-ply plate of beech wood was immersed in water at a normal temperature under a reduced pressure of about 1 Torr for 6 hours to be sufficiently saturated with water. Then the plate was processed in the same manner as in the above EXAMPLE 12, except that the plate was immersed in the first bath of a first aqueous solution of 50 weight % aluminum chloride and heated to 85° C. and left as immersed for 5 hours. As a result, a modified wood plate having dialuminum hydrogen phosphate fixed therein was obtained.

The single-ply wood plates thus obtained in these EXAMPLES 12 and 13 were subjected to measurement of increments in their weight and to the flame retardation test in accordance with JIS Standard A1321, results of which were as given in Table VI below:

TABLE VI

| EXAMPLE | Weight increment (%) | Flame retardant property |
|---|---|---|
| 12 | 60 | Good |
| 13 | 40 | Good |

According to a fifth feature of the present invention, an aqueous solution containing Ba ions and $BO_3$ ions as well as another aqueous solution containing $BO_3$ ions and $PO_4$ ions are made to impregnate in the raw wood material, and the material is cured to have an insoluble, non-flammable inorganic compound dispersed and fixed therein, to obtain a modified wood material.

More specifically, in an embodiment realizing the fifth feature, a raw wood material is immersed in the first bath of a first aqueous solution containing Ba and $BO_3$ ions, and the material impregnated with the first aqueous solution is then immersed in the second bath of a second aqueous solution containing $BO_3$ and $PO_4$ ions, so that the first aqueous solution will react with the second solution to produce such insoluble, non-flammable inorganic compound as apatite in the wood, and a modified wood material can be obtained.

For the inorganic compounds containing Ba, $BO_3$ and $PO_4$ ions, one or more of compounds listed in Table VII below may be employed:

TABLE VII

| Ion | Compound |
|---|---|
| Ba | Barium chloride, barium bromate, barium nitrate, barium hydroxide, etc. |
| $BO_3$ | Boric, acid, sodium metaborate, potassium metaborate, etc. |
| $PO_4$ | Phosphoric acid, trisodium phosphate, disodium hydrogen phosphate, sodium dihydrogen phosphate, ammonium phosphate, diammonium hydrogen phosphate, ammonium hydrogen phosphate, etc. |

In this case, one or a combination of two or more of the compounds in the respective groups may be used. Further, the pH during the reaction between the first and second solutions is set at an alkaline level of preferably 8 or higher, optimumly in a range of 8 to 10.

Practical examples for realizing the fifth feature will be explained below:

EXAMPLE 14

As a pretreatment, a single-ply beech wood plate of 3 mm thick was immersed in water at a normal temperature under a reduced pressure of about 30 Torr for 5 hours to be sufficiently saturated with water. Then the plate was immersed in the first bath containing a first aqueous solution of a mixture of barium chloride and boric acid and left as immersed for 5 hours. Next, the plate impregnated with the first aqueous solution was immersed in the second bath containing a second aqueous solution of a mixture of diammonium hydrogen phosphate and boric acid and was left as immersed for 3 hours, after which the plate was moved into a third bath containing an alkaline aqueous solution adjusted to be between 8 and 10 in the pH level by adding sodium hydroxide, and was left as immersed for 5 hours. Thereafter, the plate was taken out of the third bath, washed with water and dried, and a modified plate having the insoluble, non-flammable inorganic compound fixed therein was obtained.

EXAMPLE 15

The same single-ply wood plate as above was subjected to the same processing as in the above EXAMPLE 14 up to the second bath immersion, and was then immersed in the alkaline aqueous solution of the pH level between 8 and 10 to be impregnated with the alkaline solution. The plate was then washed with water and dried, and a modified single-ply wood plate having the insoluble, non-flammable inorganic compound fixed therein was obtained.

EXAMPLE 16

The same wood plate was processed in the same manner as in EXAMPLE 14, except that the first bath contains an aqueous solution of a mixture of barium bromate and boric acid, in place of the mixture aqueous solution of barium chloride and boric acid. As a result, a modified single-ply wood plate was obtained.

EXAMPLE 17

The same wood plate was processed in the same manner as in EXAMPLE 14, except that the second bath a mixture aqueous solution of disodium hydrogen phosphate and boric acid, instead of the mixture aqueous solution of ammonium hydrogen phosphate and boric acid. As a result, a modified single-ply wood plate was obtained.

The respective modified single-ply wood plates thus obtained in EXAMPLES 14 to 17 were subjected to measurement of increments in their weight and to the flame retardation tests in accordance with JIS Standard A1321, results of which were given in Table VIII below:

TABLE VIII

| EXAMPLE | Weight increment (%) | Flame retardant property |
|---|---|---|
| 14 | 150 | Good |
| 15 | 150 | Good |
| 16 | 160 | Good |
| 17 | 160 | Good |

From the foregoing, it will be appreciated that all the modified wood plates obtained by embodying the first to fifth features according to the present invention have the insoluble, non-flammable inorganic compound effectively produced therein, and that the plates are provided with a high flame retardant property. When the inorganic compound fixed in the wood contains phosphoric acid, a pyrolysis, i.e., carbonization is promoted during combustion of the wood and a resultant carbonized layer functions as a heat insulating layer, so that the flame retardant property of the wood can be thereby much improved. When the modification of wood is completed, further, the insoluble, non-flammable inorgnaic compound produced is firmly fixed in the wood texture so as not to be caused to flow out of the texture even by water entering into the texture. As a result, it is made possible that, not only the dimensional stability thereby realized, but also the inside pores of the wood texture can be filled with the compound, so that the wood texture can be protected from any invasion of putrefactive bacteria and insects, and the wood can exhibit the high rot-proof and moth-proof properties.

The same process as in EXAMPLE 14 was carried out with respect to tilia japonica timber, and a resultand modified single-ply wood plate thus obtained was subjected to a test of the rot-proof effectiveness by means of ·tyromyces palustris and coriolus versicolor employed as testing bacteria. In this case, a weathering operation was performed in accordance with JWPA Standard, Item No. 1, for a testing period set to be 6 weeks, and thereafter the decrease in weight and rot-proof effectiveness value were measured, through which it was found that the modified wood plate was in possession of a remarkably higher rot-proof effectiveness than that of unprocessed wood plate. Results of the test are as shown in Table IX below:

TABLE IX

| Testing Bacteria | | Processed | Un-processed |
|---|---|---|---|
| *tyromyces palustris* | Weight decrease | 14.5 | 41 |
| | (%) Effect. value | 62 | — |
| *coriolus versicolor* | Weight decrease | 9.1 | 33.6 |
| | (%) Effect. value | 73 | — |

In the present instance, it should be appreciated that the effectiveness value is represented by the percentage of a difference between the values of the processed plate and unprocessed plate which is divided by the value of unprocessed plate.

Further, a test of the moth-proofness against white ants was performed with respect to the same modified single-ply wood plate of tilia japonica timber obtained through the same process as in EXAMPLE 14, in accordance with JWPA Standard, Item No. 11 in the present case, for a testing period set to be 3 weeks. The death rate of the white ants (soldier ants) during the test period and the decrease in weight of the plate after the test period were measured, and it has been found that the modified wood plate had a much higher moth-proofness than the unprocessed wood plate. Results of the test are as shown in following Table X:

TABLE X

| | | Processed | Unprocessed |
|---|---|---|---|
| Death rate: | After 3 days | 0.4 (8.9) | 0.7 (8.9) |
| | After 1 week | 53.3 (77.8) | 0.7 (13.3) |
| | After 2 weeks | 93.1 (100) | 0.7 (15.6) |
| | After 3 weeks | 100 | 11.3 (15.6) |
| Weight decrease (%): | | 4.1 | 19.7 |

In the above Table X, the respective parenthesized values are of the wood plates with respect to which the weathering operation has been performed.

In view of the foregoing description, it should be appreciated that, in any one of the modified wood materials obtained by realizing the first to fifth features of the present invention, the insoluble, non-flammable inorganic compound is produced effectively in the wood material to provide thereto the high flame retardancy. In the case when phosphoric acid is included in the organic compound fixed in the wood material, the pyrolysis, that is, the carbonization is thereby promoted upon combustion of the wood material, and the carbonized layer thereby produced in the wood material acts as the heat insulating layer so that the flame retardancy can be further improved. Since the insoluble, non-flammable inorganic compound is firmly fixed inside the wood texture upon completion of the modification of wood material, further, there can be shown such effects that, in addition to that the dimensional stability is achieved, the pores in the wood texture made solid as filled with the compound will prevent any invasion of the putrefactive bacteria or insects from occurring so that the high rot-proofness and moth-proofness can be attained.

What is claimed as our invention is:

1. A method for manufacturing a modified wood material made to contain therein an insoluble, non-flammable inorganic compound, the method comprising a step of immersing a raw wood material in a first bath of a first water-soluble inorganic substance solution containing an effective amount of metallic ions other than copper or sodium high in affinity for said wood material so as to fix said metallic ions in said wood material, wherein said metallic ions are insoluble and non-flammable in said wood material, and a step of immersing said wood material in a second bath of a second water-soluble inorganic substance solution containing an effective amount of negative ions other than chromate for producing said insoluble, non-flammable inorganic compound upon reaction of said negative ions with said metallic ions, said wood material being immersed in said first and second baths for a time sufficient to effective fix throughout said wood material and insoluble, non-flammable inorganic compound.

2. A method according to claim 1, wherein said first solution for said first bath and containing said metallic ions is an aqueous solution containing at least one selected from the group consisting of calcium bromide, calcium chloride, calcium chlorate, calcium nitrate, calcium nitrite, calcium chromate, calcium acetate, magnesium chloride, magnesium sulfate, aluminum chloride, aluminum bromide, aluminum iodide, aluminum nitrate, aluminum sulfate, barium chloride, barium bromate, barium iodide, barium nitrate, barium hydroxide, zinc oxide, zinc bromide, zinc iodide, zinc nitrate and equivalents thereto.

3. A method according to claim 1, wherein said second solution for said second bath and containing said negative ions is an aqueous solution containing at least one selected from the group consisting of ammonium carbonate, potassium carbonate, potassium hydrogen carbonate, sodium carbonate, sodium hydrogen carbonate, sodium potassium carbonate, phosphoric acid, sodium phosphate, ammonium phosphate, sodium hydroxide, potassium hydroxide, sodium sulfate, sodium hydrogen sulfate, potassium sulfate, potassium hydrogen sulfate, ammonium sulfate, sodium aluminum sulfate, potassium aluminum sulfate, ammonium aluminum sulfate, potassium magensium sulfate, sodium silicate, potassium silicate boric acid and equivalents thereto.

4. A method according to claim 1, wherein said step of immersing said raw wood material in said first bath of said first solution containing said metallic ions is carried out prior to said immersing step in said second bath of said second solution.

5. A method according to claim 1, wherein said step of immersing said raw wood material in said second bath of said second water-soluble inorganic substance solution containing said negative ions is carried out prior to said step of immersing the material in said first bath of said first solution.

6. A method according to claim 1, wherein said insoluble, non-flammable inorganic compound contained in said wood material is less than 1.0 in the solubility.

7. A method according to claim 1, wherein said first and second water-soluble inorganic substance solutions for said first and second baths are more than 5.0 in the solubility.

8. A method according to claim 1, wherein said second water-soluble inorganic substance solution containing said negative ions is a phosphoric acid series aqueous solution which is adjusted to the alkaline.

9. A method according to claim 1, wherein said insoluble, non-flammable inorganic compound contained in said wood material is apatite.

10. A method according to claim 1, wherein said apatite is one selected from the group consisting of hydroxy apatite and chloro apatite.

11. A method according to claim 1, wherein said second inorganic substance solution containing said negative ions is an alkaline aqueous solution having a pH level in a range of 8.5 to 12.

12. A method according to claim 1, wherein said insoluble, non-flammable inorganic compound contained in said wood material is metallic salt phosphate.

13. A method according to claim 1, wherein said negative ions in said second water-soluble inorganic substance solution for said second bath are phosphoric acid ions adjusted to be substantially neutral in pH level.

14. A method according to claim 1, wherein said first water-soluble inorganic substance solution containing said metallic ions is an aqueous solution containing Ba and $BO_3$ ions, while said second water-soluble inorganic substance solution containing negative ions is an aqueous solution containing $BO_3$ and $PO_4$ ions.

15. A method according to claim 1, wherein said insoluble, non-flammable inorganic compound contained in said wood material is more than 40 weight %.

* * * * *